US006062273A

United States Patent [19]

Peeters et al.

[11] Patent Number: 6,062,273

[45] Date of Patent: May 16, 2000

[54] DEVICE FOR THE SUPPLY OF COMPRESSED AIR TO A MAIN JET NOZZLE OF AN AIR SHUTTLE LOOM

[75] Inventors: Jozef Peeters; Jean-Marie Bamelis, both of Ypres, Belgium

[73] Assignee: Picanol n.v., Belgium

[21] Appl. No.: 09/117,544

[22] PCT Filed: Jan. 23, 1997

[86] PCT No.: PCT/EP97/00303

§ 371 Date: Dec. 2, 1998

§ 102(e) Date: Dec. 2, 1998

[87] PCT Pub. No.: WO97/29231

PCT Pub. Date: Aug. 14, 1997

[30] Foreign Application Priority Data

Feb. 9, 1996 [BE] Belgium ..... 9600116

[51] Int. Cl.[7] ..... D03D 47/30

[52] U.S. Cl. ..... 139/435.2; 251/129.04

[58] Field of Search ..... 139/435.2; 251/129.04

[56] References Cited

U.S. PATENT DOCUMENTS

| | | | |
|---|---|---|---|
| 4,410,016 | 10/1983 | Maners | 139/435.2 |
| 4,534,387 | 8/1985 | Van Hest | 139/435.2 |
| 4,651,785 | 3/1987 | Volland et al. | 1398/435.2 |
| 5,086,812 | 2/1992 | Van Bogaert et al. | 139/435.2 |

FOREIGN PATENT DOCUMENTS

| | | | |
|---|---|---|---|
| 3300934 | 7/1983 | Germany | 139/435.2 |

*Primary Examiner*—Andy Falik
*Attorney, Agent, or Firm*—Bacon & Thomas PLLC

[57] ABSTRACT

Apparatus for supplying compressed air to a main blowing nozzle of an airjet loom for filling insertions includes an integrated air feed unit including an intake directly connected to the compressed air supply, an outlet connected to the main blowing nozzle and air flow control valves including valve drivers. Main and bypass ducts provide communication between the intake and the outlet with the airflow control valves controlling the supply of air to the outlet of the air feed unit. The air flow control valves include a check valve arranged to control in an on/off manner the supply of compressed air from the main duct to the outlet; a first adjustable throttling valve arranged to control the pressure of compressed air supplied to the outlet during filling insertions when the check valve is open and a second adjustable throttling valve arranged to control the pressure of compressed air supplied to the outlet between filling insertions when the check valve is closed. A pressure control monitor may be connected to the air feed unit for supplying pressure signals to the loom control system. Individual main nozzles may be provided with respective individual integrated air feed units.

20 Claims, 4 Drawing Sheets

P
T
66
1
2
3
4
5
6
7
8
9
10
11
12
13
14
15
16
17
18
46
47
48
49
50
52
56
57
65
67

DEVICE FOR THE SUPPLY OF COMPRESSED AIR TO A MAIN JET NOZZLE OF AN AIR SHUTTLE LOOM

BACKGROUND OF THE INVENTION

1. Field of the Invention

The invention relates to apparatus supplying compressed air to the main blowing nozzle of an airjet loom and connected by ON/OFF and/or adjustable valves to a source of compressed air.

2. Related Art

Such apparatus is known for instance from U.S. Pat. No. 5,086,812 and supplies highly compressed air to a main blowing nozzle and to the accessory main blowing nozzle during insertion of a filling yarn. Compressed air at a lower pressure is fed to the main blowing nozzle (and to the accessory main blowing nozzle) during the time interval between two filling insertions, said lower pressure being selected in such manner that the filling shall not drop out of the main blowing nozzle. The high-pressure compressed air is fed through a line containing a throttling valve and a check valve to the main blowing nozzle. The low-pressure compressed air is supplied through a line bypassing the check valve and the throttling valve and containing its own throttling valve.

SUMMARY OF THE INVENTION

The objective of the invention is to create apparatus of the above kind which shall keep at a low value the response time between opening the check valve and the actual application of high-pressure compressed air.

This problem is solved by providing an integrated or unitary air feed unit comprising an intake connected to the compressed-air supply and an outlet connected to the main blowing nozzle, said unit further containing ducts connecting intake and outlet and fitted with valves.

The heretofore conventional configuration of several connecting lines entail pressure drops that increase the response time especially during the opening of the check valve and during the actual application of high-pressure compressed air to the main blowing nozzle and such pressure drops can be eliminated by using an air feed unit. Moreover the elimination of a plurality of connecting lines offers greater compactness and particularly an inspectable configuration. This feature is especially advantageous in airjet looms comprising several main blowing nozzles for inserting different fillings.

In one embodiment of the invention, the air feed unit comprises a main duct connecting the intake to the outlet and fitted with a check valve and/or a throttle valve and further containing a bypass duct shunting the check valve and fitted with a throttle valve. This design offers high compactness because only one connection is needed between the air feed unit to the compressed-air source and to the main blowing nozzle, other connecting lines not being required.

In another embodiment of the invention, the valves comprise plungers which are displaceable inside boreholes of the air feed unit and include drives that are affixed to the air feed unit and include drives that are affixed to the air feed. The air feed unit together with the valves constitutes thereby a compact component assembled as such and if need be disassembled as such.

In yet another embodiment of the invention, the air feed unit is mounted on a manifold reservoir. This feature eliminates also a connecting line between the manifold reservoir and the air feed unit because the latter can be hooked up by its intake to an outlet aperture of the manifold reservoir.

In another embodiment of the invention, a pressure sensor preferably generating electrical signals is mounted after the valves. This pressure sensor may also be part of the component formed by the air feed unit and allows monitoring the operation and/or the settings of check valves and throttling valves.

In another embodiment of the invention, the air feed unit is fitted with an electrical connector to which electrical conductors leading to the valves and/or to the pressure sensor can be hooked up and which may receive one or more plug elements for conductors leading to a control unit. This configuration also offers simple and easily surveyed electrical connections between the particular valves and the control unit.

A further embodiment of the invention comprises several main blowing nozzles each fitted with its own air feed unit. An inspectable configuration is achieved even though there are several main blowing nozzles. Moreover different pressure levels may be set at the several main blowing nozzles to allow inserting of different fillings in an advantageous manner.

BRIEF DESCRIPTION OF THE DRAWINGS

Further features and advantages of the invention are elucidated in the following description of illustrative embodiments shown in the drawings.

DETAILED DESCRIPTION OF THE PREFERRED EMBODIMENTS

Figures 1, 3:
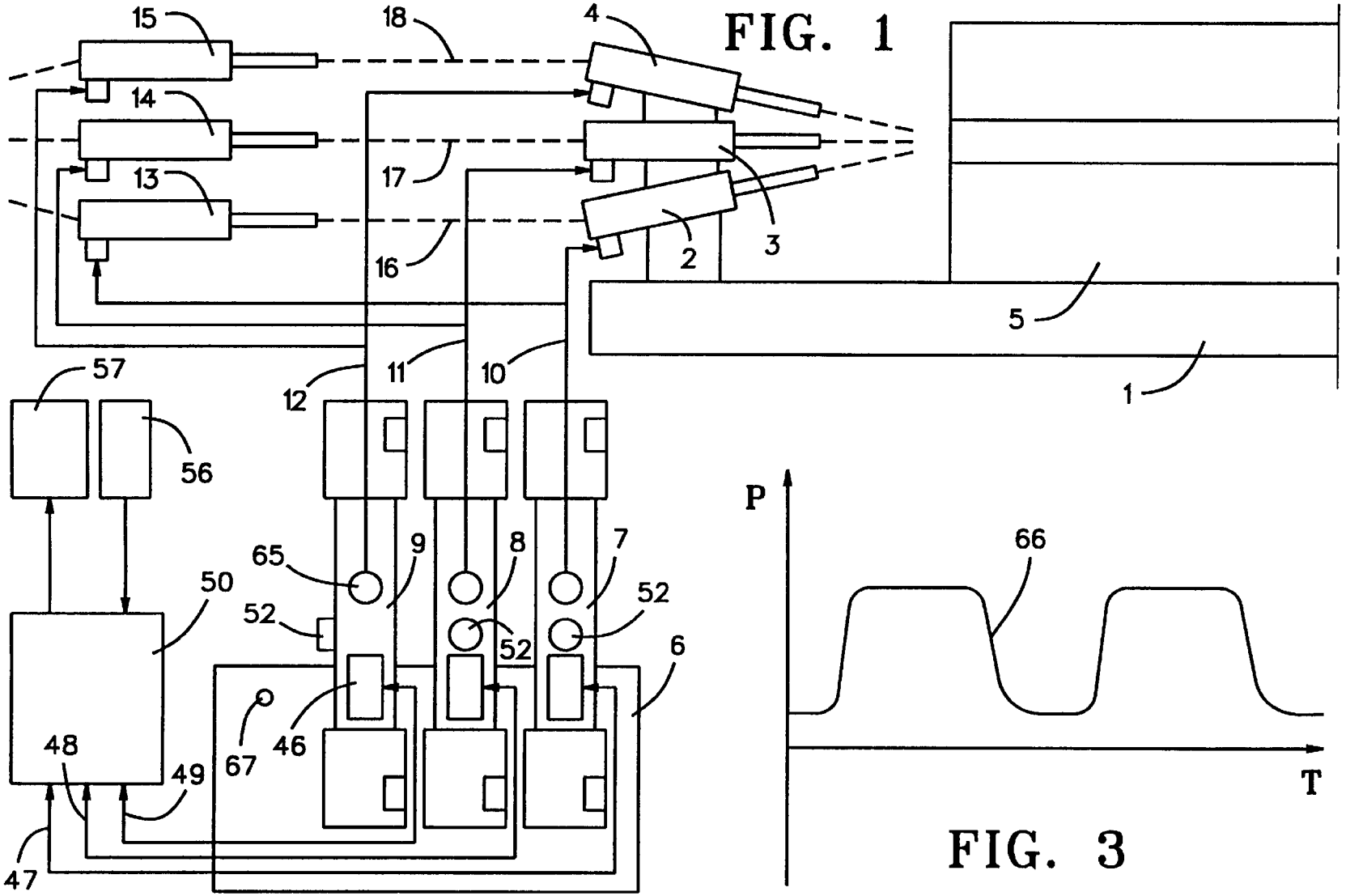
FIG. 1 is a schematic of part of an airjet loom comprising apparatus according to the invention for supplying compressed air to several main blowing nozzles and to accessory main blowing nozzles preceding them.
FIG. 3 shows an illustrative pressure function of consecutive filling insertions using a main blowing nozzle.

The airjet loom only outlined in FIG. 1 contains a batten 1 supporting a total of three main blowing nozzles 2, 3, 4. Moreover a contoured reed 5 forming a U-shaped filling insertion-duct is mounted on the batten. Said filling insertion-duct is combined with so-called relay nozzles not shown in further detail. The loom also comprises a compressed-air, manifold reservoir 6 fitted with apparatus 7, 8, 9 to supply compressed air to the main blowing nozzles 2, 3, 4 through (flexible) lines 10, 11, 12. As also shown in FIG. 1, an auxiliary main blowing nozzle 13, 14, 15 is conventionally mounted in front of the main blowing nozzles 2, 3, 4 resp. and is each connected to the lines 10, 11, 12 so that they receive compressed air in the same manner as the main blowing nozzles 2, 3, 4. The auxiliary main blowing nozzles 13, 14, 15 are mounted in stationary manner and each cooperates with the particular associated main blowing nozzle 2, 3, 4 to insert a filling 16, 17, 18.

Figure 2:
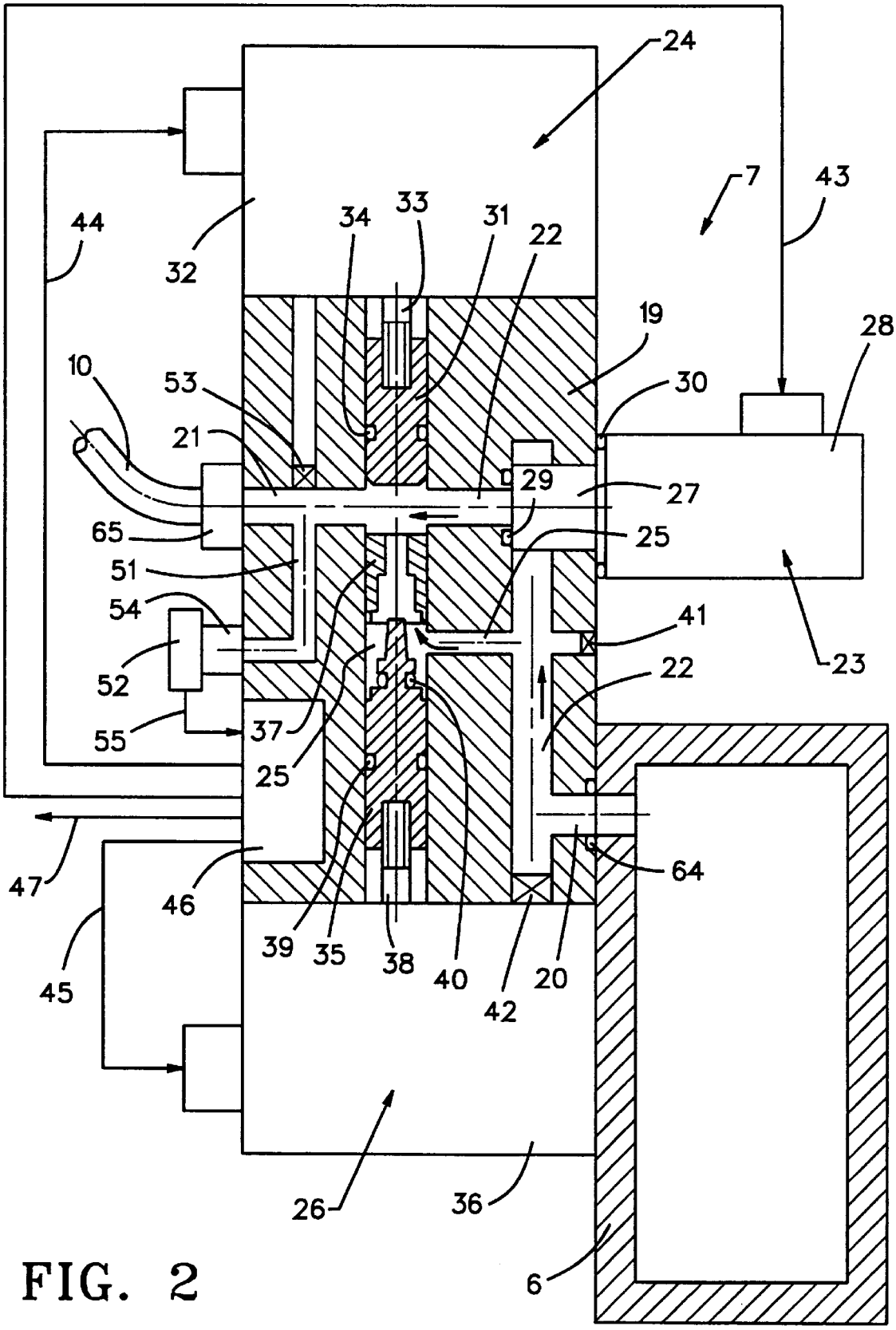
FIG. 2 is a cross-section of an air feed unit of the apparatus of the invention.
Figure 4:
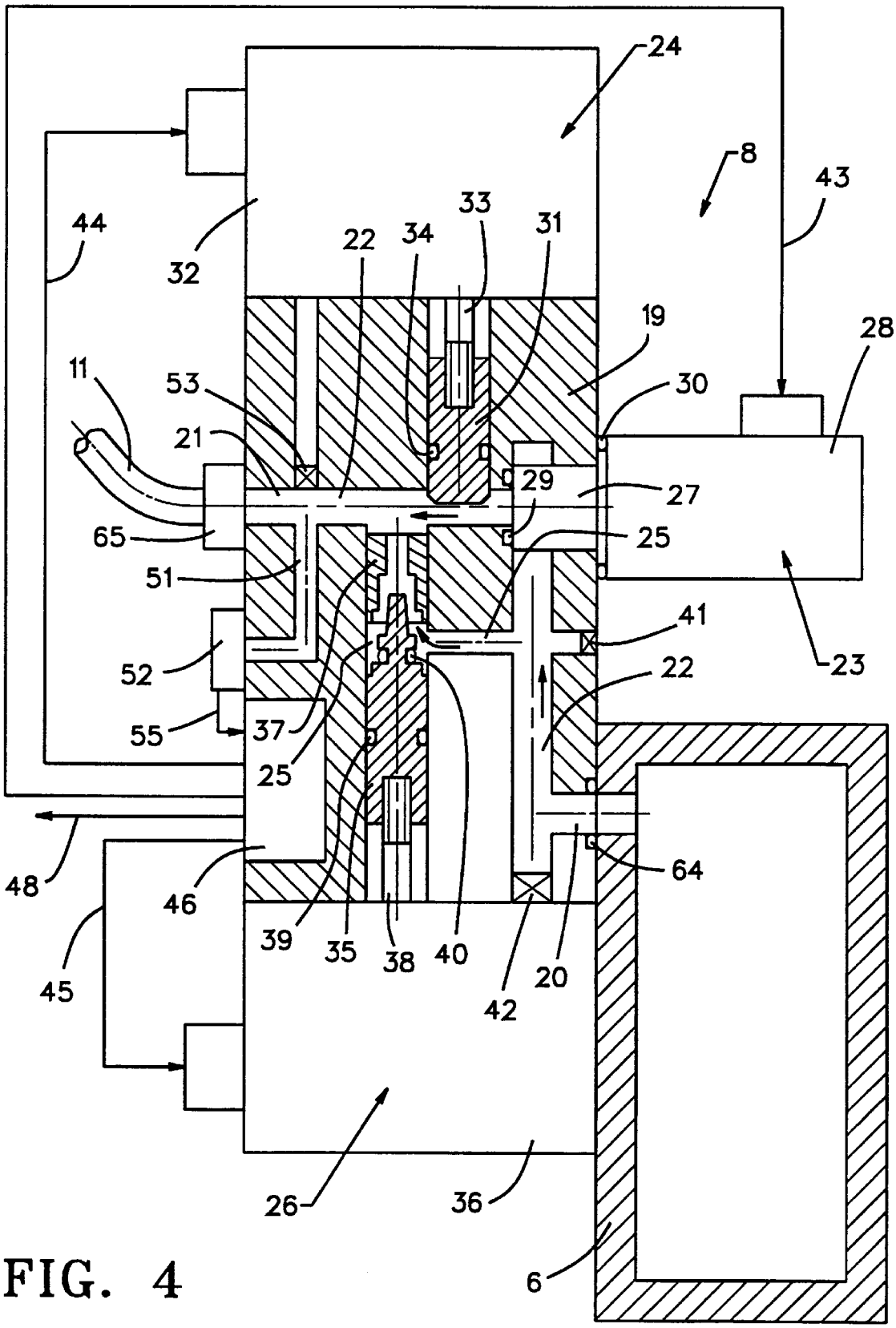
FIG. 4 is a cross-section of an air feed unit similar to that of FIG. 2
Figure 5:
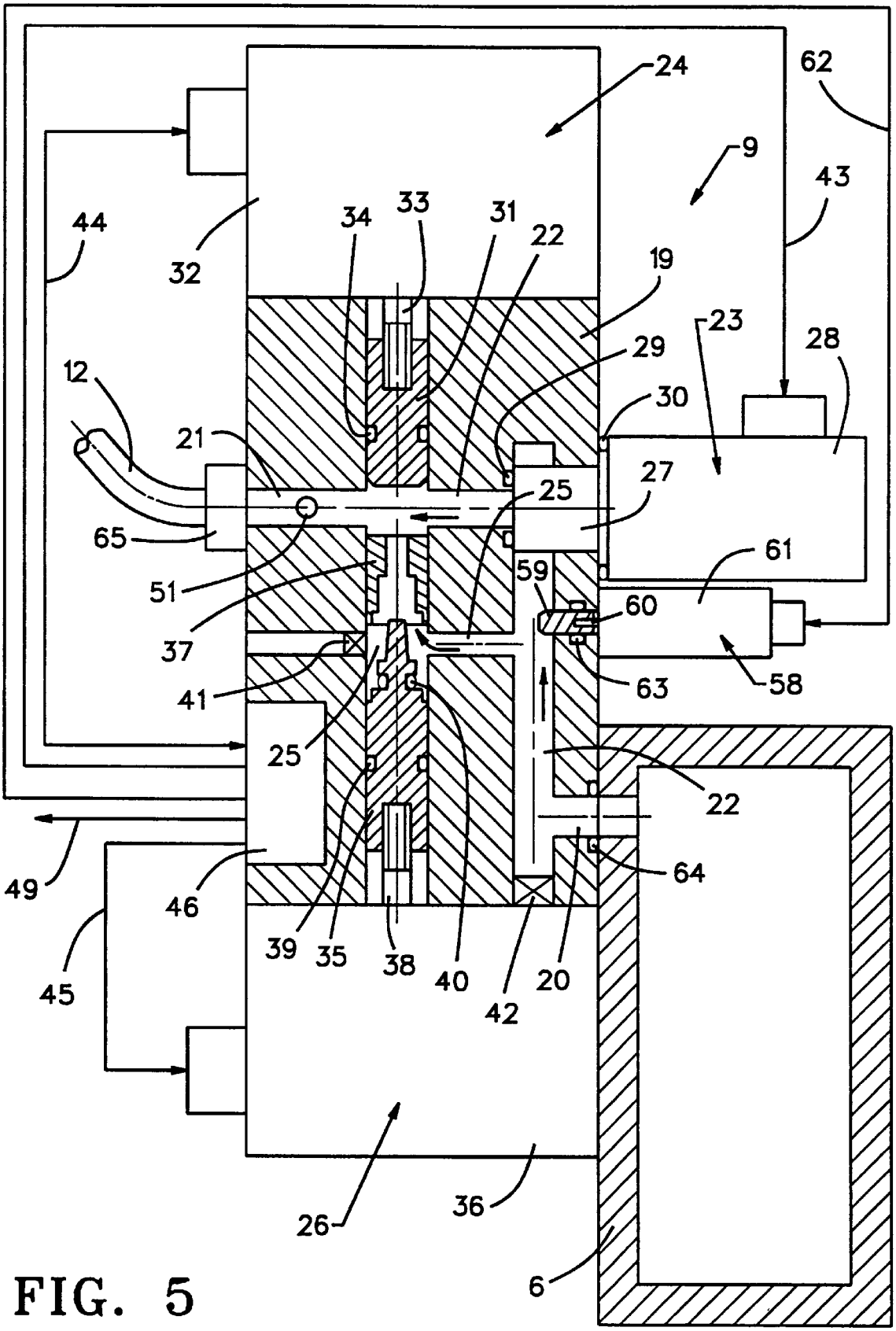
FIG. 5 shows another embodiment of an air feed unit similar to the cross-section of FIG. 2 or FIG. 4.

The apparatus 7, 8, 9, each differing slightly, are shown in detail in FIGS. 2, 4 and 5 to elucidate different embodiments of the invention. However as regards in an airjet loom used in practice, a single embodiment will be utilized at any one time.

The apparatus 7, 8, 9 of FIGS. 2, 4 and 5 each comprise an integrated air feed unit 19 fitted with a compressed-air intake 20 and outlet 21. A main duct 22 consisting of two mutually perpendicular boreholes is present in the air feed unit 19 between the intake 20 and the outlet 21. This main duct 22 contains an ON/OFF check valve 23 and a first, adjustable throttling valve 24. A bypass duct 25 is present between the intake 20 and the outlet 21 in the air feed unit 19 to shunt the check valve 23 and the first throttling valve 24. A second adjustable throttling valve 26 is present in this bypass duct 25. The intake of the bypass duct 25 connects to the main duct 22 between the intake 20 of the air feed unit 19 and the check valve 23. The outlet of the bypass duct 25 discharges, between the check valve 23 and the outlet 21 of the air feed unit 19, into the main duct 22. The bypass duct 25 consists of two mutually perpendicular boreholes in the air feed unit 19, one borehole being perpendicular to the first part of the main duct 22 and the other borehole being perpendicular to the second part of the main duct 22.

The first throttling valve 24 is located behind the check valve 23 as seen in the direction of flow. This feature offers the advantage that more air is flowing at a given flow aperture through the check valve 23 than if the first check valve 24 were mounted in front of the check valve 23 as seen in the direction of flow. The throttling valve 24 is mounted closely behind the check valve 23, whereby, upon opening of the check valve 23, the pressure buildup at the outlet 21 of the air feed unit 19 rapidly rises to the desired value set by the throttling valve 24. The segment of the main duct 22 before the check valve 23 is selected to be large to make air drag negligibly small. The segment of the main duct 22 after the check valve 23 should be small to assure that pressure buildup takes place rapidly. To keep air drag small, at least this segment of the main duct 22 is made straight.

The check valve 23 is fitted with a plunger 27 displaceable inside a borehole of the air feed unit 19 and moves to and fro when driven by an electric drive 28. Illustratively the drive 28 consists of a switched electromagnet displacing the plunger 27 as a function of the applied voltage in one of the two directions. The drive 28 is affixed by fasteners (not shown) to the air feed unit 19. The plunger 27 is adjustable relative to the beginning of the segment of the main duct 22 leading to the outlet 21. The beginning of this segment of the main duct 22 is enclosed by a sealing ring 29 abutted by the plunger 27 to block compressed air from flowing into the main duct 22. A sealing ring 30 preventing leakage of compressed air is mounted between the drive 28 and the air feed unit 19.

The first throttling valve 24 determining the pressure at which the filling is inserted contains a plunger 31 displaceable inside a borehole of the air feed unit 19. The plunger 31 can be moved to and fro by a drive 32. Preferably the drive 32 contains a controllable stepping motor converting rotation into the linear motion of a push-pin 33 connected to the plunger 31. The drive 32 is affixed by omitted fasteners (not shown) to the air feed unit 19. The plunger 31 is fitted with a sealing ring 34 to prevent compressed air from leaking along the plunger 31. Throttling of the compressed air flowing in the main duct 22 is implemented by the plunger 31 moving into the main duct 22 and thereby limiting the flow cross-section of the main duct 22.

The second throttling valve 26 sets the lower pressure and contains a plunger 35 which is displaceable inside a borehole of the air feed unit 19 and which is movable to and fro by a drive 36, said plunger 35 cooperating with a valve seat 37 which is stationary in said borehole. Preferably the drive 36 is fitted with a stepping motor converting rotation into the linear motion of a push-pin 38 connected to the plunger 35. The drive 36 is affixed by fasteners (not shown) to the air feed unit 19. The plunger 35 is fitted with a sealing ring 39 preventing the compressed air from escaping along the plunger 35. Throttling is implemented by displacing the plunger 35 to change the flow cross-section between the plunger 35 and the valve seat 37 . The plunger 35 also contains a second sealing ring 40 cooperating with the valve seat 37 to block compressed air from passing through the bypass duct 25.

The configuration of the check valve 23, throttle valves 24 and 26, main duct 22 and bypass duct 25 is selected in such manner that only a low number of boreholes is required in the air feed unit 19. If these boreholes are open-ended and compressed air must not leak from them, they will be sealed by stoppers 41, 42 and 53.

By using stepping motors of which the rotation is converted into the linear motion of the push-pin 33, 38, the plungers 31 or 35 can be displaced in very small steps and accordingly the throttling effect of the throttling valves 24 or 26 is controlled in simple and very fine manner.

The electric conductors 43, 44, 55 for the drives 28, 32, 36 terminate in a connector element 46 indicated only in schematic manner and affixed to the air feed unit 19. As indicated in diagrammatic manner in FIG. 1, the connector element 46 accepts matching connector elements fitted on cables 47, 48, 49 leading to a control unit 50 for the airjet loom.

When a filling must be inserted, the check valve 23 opens to let the compressed air from the manifold reservoir 6 flow through the main duct 22 and the adjoining line 10, 11, 12 of the associated main blowing nozzle 2, 3, 4 and to auxiliary accessory main blowing nozzle 13, 14, 15. The pressure level of the compressed air in the vicinity of the outlet 21 of the main duct 22 is determined by the position of the plunger 31 of the throttling valve 24. The level of this pressure can be changed by changing the said position. After the filling has been partly inserted, the check valve 23 is closed again. Thereafter compressed air from the manifold reservoir 6 moves only through the bypass duct 25 to the particular main blowing nozzle. In this case the pressure level of the compressed air in the vicinity of the outlet 21 is determined by the position of the plunger 35 of the second throttling valve 26. The pressure level predetermined by the second throttling valve 26 is low and selected in such manner that only that quantity of compressed air will flow at such a pressure level to the particular main blowing nozzle that will suffice to reliably hold a filling in the main blowing nozzle.

In a preferred embodiment, an electric pressure sensor 52 is associated with the air feed unit 19 to make it possible to measure the compressed-air pressure level beyond the two adjustable throttling valves 24, 26. The electrical pressure sensor 52 emits an electrical signal corresponding to the measured pressure level for enabling recordal of the pressure as a function of time. By means of boreholes 51 in the air feed unit 29, the pressure sensor 52 is connected to the main duct 22 in the vicinity of the outlet 21. One of the two mutually perpendicular boreholes is closed by a stopper 53. Also a plug-in system 54 is provided which is affixed to the air feed unit 19 and to which the pressure sensor 52 at the air feed unit 19 can be fastened. This plug-in system 54 comprises seals not shown in further detail that prevent compressed air from escaping through said system when the pressure sensor 52 has been removed. The pressure sensor 52 is connected by an electrical line 55 to the connector element 46 and by the associated connector element to the loom's control unit 50. In a variation of the embodiment, the line 55 is directly hooked-up to the control unit 50.

The pressure sensor 52 picks up the compressed-air pressure level at a location which, seen in the direction of flow, is behind the throttle valves 24, 26, and therefore it measures the pressure level which is approximately that at the outlet 21 of the air feed unit 19; that is, it is approximately the same as the pressure level which is determined by the settings of the throttling valves 24 or 26 and at which the compressed air is supplied to the main blowing nozzles. As a result, based on pressure measurements made by the pressure sensor 52, the throttling valves 24 and 26 can be properly set. The desired pressure level is set, using an input unit 56, at the control unit 50 which so controls the drives 32, 36 of the throttle valves 24, 26 that the actual pressure level coincides with the predetermined one.

While weaving, the pressure level illustratively may be a function 66 as shown in FIG. 3. The electrical pressure sensor 52 measures the pressure P over time T and consequently this pressure function 66 can be reproduced at a display 57 connected to the control unit 50. Such an electrical pressure sensor 52 recording the pressure as a function of time offers the advantage over a conventional manometer in that the pressure level and the pressure function can be determined during weaving and also can be set without needing to shut down the loom. The pressure function 66 includes a low-pressure portion determined by the throttling valve 26 and a high-pressure portion determined by the throttling valve 24. Moreover the control unit 50 can be arranged to transmit the maximum and minimum values of the pressure to the display unit 57 to be displayed there. Also the response time of pressure buildup or pressure fall can be reproduced at the display 57. Illustratively the pressure-buildup response time is the time interval between the time when the drive 28 of the check valve 23 is first actuated to open and the time at which the pressure is for instance 90% of maximum. Illustratively a pressure fall response time is the time interval between the time of first controlling the drive 28 of the check valve 23 to close and the time at which the pressure is for instance 50% of its maximum. Determining these times will indicate whether the check valve 23 is operating properly. Moreover the response times and the pressure function can be monitored by the control unit over substantial time intervals in order to ascertain any deviations from initial values. This procedure allows for instance to spot wear in the check valve 23 and/or in the throttling valves 24, 26. Mounting a pressure sensor 52 and the resulting, above-discussed ability to monitor and/or set the pressure function 66 and hence of the valves is itself an invention which may be advantageous even if no air feed unit 19 is present.

In the embodiment of the apparatus 8 shown in FIG. 4, the plungers 31 and 35 are mounted in offset boreholes of the air feed unit 19. As seen in the direction of flow, the plunger 31 is situated at a location of the main duct 22 that is in front of the mouth of the bypass duct 25. This feature offers the advantage that the maximum pressure level is solely determined by the throttling valve 24 and the minimum pressure level solely by the throttling valve 26. In this embodiment the pressure sensor 52 is mounted by fasteners (not shown) directly on the air feed unit 19, that is a plug-in system 54 is not used.

Compared with the design of FIG. 2, the plunger 31 is located at a position in which it will enter more deeply the main duct 22. The plunger 35 is displaced more deeply into the valve seat 37 than it is in the position of FIG. 2.

In the configuration of the apparatus 9 shown in FIG. 5, a throttling valve 58 is provided in addition to the throttling valve 24 in the main duct 22 and is mounted, as seen in the direction of flow, before the check valve 23 and is associated with the main duct 22. This throttling valve 58 contains a plunger 59 controlled from a drive 61 through a push-pin 60. Similarly to the drive 32, this drive 61 contains a stepping motor of which the rotation is converted into linear motion. The drive 61 is connected by an electric line 62 to the connector element 46. A sealing ring 63 is present for this throttling valve 58 in the borehole of the air feed unit 19 guiding the plunger 59. In this embodiment the pressure sensor 52 is offset by 90° compared to the pressure sensor 52 of the apparatus 7 and 8 shown in FIG. 1. Accordingly the pressure sensor 52 is connected solely by a straight borehole 51 to the main duct 22.

As shown by FIG. 1, the apparatus 7, 8, 9, of which the main components in each case is an air feed unit, are mounted adjacent to each other in inspectable manner. This feature favors compactness of the entire system. The apparatus 7, 8 and 9 are directly affixed to the manifold reservoir 6 and thereby further connection lines are eliminated. The particular throttling valves allow setting different pressure levels of the compressed air fed to the main blowing nozzles 2,3,4 even when the pressure level of the compressed air in the manifold reservoir 6 is the same for all main blowing nozzles. With each apparatus 7, 8, 9 of the invention being fitted with a connector element 46, the electric lines 47, 48, 49 to the control unit 50 also can be configured in simple manner.

As shown in FIGS. 2, 4 and 5, the air feed units 19 are directly affixed to the manifold reservoir 6 by screws (not shown). Sealing rings 64 are present in each case between the feed units 19 and the manifold reservoir 6 to prevent leakage of compressed air. The direct affixation of the air feed units 19 to the manifold reservoir 6 offers not only the advantage of eliminating connection lines but also advantages regarding flow losses and compactness. A fitting 65 is mounted at each of the outlets 21 of the air feed units 19 to hook up the lines 10, 11 or 12. As further shown by FIG. 1, the manifold reservoir 6 may be fitted with further apertures to be connected to the air feed units and sealed with plugs 67 when not in use.

If the pressure sensor 52 is directly affixed to the air feed units 19 of the apparatus 7, 8, 9, then appropriately each air feed unit 19 shall include its own pressure sensor 52. If however the pressure sensor 52 is directly affixed by a plug-in system 54 to the air feed unit 19, a single pressure sensor 52 may suffice and be selectively hooked up to an air feed unit 19 of an apparatus 7, 8 or 9. The input unit 56 can notify the control unit 50 which apparatus 7, 8 or 9 is measuring the pressure level and/or the pressure time-function.

In another embodiment, several manifold reservoirs are used and each is connected to one apparatus 7, 8 or 9. Each manifold reservoir then can be connected through its own feed line and when called for through its own pressure regulator, to a source of compressed air.

In another embodiment variation of the invention, the throttling valve 24 and the check valve 23 are combined into a single valve. Illustratively the plunger 31 of the throttling valve 24 may be configured in such manner that, when moved beyond its throttling position, it shall completely block the main duct 22.

In a further embodiment, the drive of the check valve 23 may be designed in such a manner, illustratively using a stepping motor, that the plunger 27 when not in the blocking position shall be adjustable into desired throttling positions. In other words, a single valve is used meeting the functions both of the check valve 23 and that of the throttling valve 24, that is, this single valve can block the main duct 22 and throttle in a predetermined manner the compressed air flowing through the main duct 22.

The invention is not restricted to the above shown embodiments that were discussed for didactic purposes. The expert may carry out many alterations without thereby transcending the scope of the claims.

What is claimed is:

1. Apparatus (7, 8, 9) to supply compressed air to a main blowing nozzle (2, 3, 4) of an airjet loom for filling insertions, comprising:

a compressed air supply (6);

an integrated air feed unit (19) comprising an intake (20) connected to the compressed air supply (6), an outlet (21) connected to a main blowing nozzle (2, 3, 4), air flow control valves (23,24,26) and main and bypass ducts (22,25) connected to the intake (20) and the outlet (21) in communication with the airflow control valves and said supply and outlet;

said air flow control valves including a check valve (23) arranged to control in an on/off manner the supply of compressed air from the main duct to the outlet; a first adjustable throttling valve (24) arranged to control the pressure of compressed air supplied to the outlet during filling insertions when the check valve is open, and a second adjustable throttling valve (26) arranged to control the pressure of compressed air supplied to the outlet between filling insertions when the check valve is closed.

2. Apparatus as claimed in claim 1, said bypass duct (25) configured to shunt the check valve (23); and said second throttling valve (26) arranged to control flow through the bypass duct (25).

3. Apparatus as claimed in claim 1, wherein the air feed unit (19) includes boreholes and valve drivers (28, 32, 36); wherein said air flow control and valves comprise plungers (27, 31, 35) displaceable inside the boreholes by said valve drivers and the drivers (28, 32, 36,) are mounted on the air feed unit (19).

4. Apparatus as claimed in claim 3, wherein the valve drivers of the throttling valves (24, 26) each comprises a stepping motor.

5. Apparatus as claimed in claim 1, including an auxiliary main blowing nozzle (13, 14, 15) preceding the main blowing nozzle (2, 3, 4) and which is connected to the outlet of the air feed unit (19).

6. Apparatus as claimed in claim 1, wherein the air feed unit (19) is mounted directly on a compressed air supply manifold reservoir (6).

7. Apparatus as claimed in claim 1, further including one or more additional main nozzles and one or more additional air feed units (19), and wherein each of the main nozzles is fitted with its own one of the air feed units (19).

8. Apparatus as claimed in claim 1, wherein the check valve (23) includes a drive mounted on the air feed unit and connected to a plunger movable in response to drive motion between a duct blocking position and variable flow throttling positions.

9. Apparatus as claimed in claim 1, wherein relative to the flow of compressed air from the intake (20) to the outlet (21) the check valve is located upstream of said first throttling valve.

10. Apparatus (7, 8, 9) to supply compressed air to a main blowing nozzle (2, 3, 4) of an airjet loom, comprising: an ON/OFF and/or adjustable valves (23, 24, 26, 28, 58) connected to a compressed air supply (6); an integrated air feed unit comprising an intake (20) connected to the compressed air supply (6) and an outlet (21) connected to the main blowing nozzle (2, 3, 4), and ducts (22, 25) associated with the valves (23, 24, 26, 58), the ducts being connected to the intake (20) and the outlet (21); and a pressure sensor (52) in communication with at least one of said ducts configured to generate electric pressure signals mounted downstream of the adjustable valves (24, 26).

11. Apparatus as claimed in claim 10, wherein one of the ducts (22, 25) is a main duct (22), and the pressure sensor (52) is mounted on the air feed unit (19) and is in communication with the main duct (22) through at least one borehole (51).

12. Apparatus as claimed in claim 11, wherein the air feed unit (19) is fitted with a plug-in connector (54) connecting the pressure sensor (52) to the air feed unit.

13. Apparatus as claimed in claim 10, including a control unit (50) for the loom, the pressure sensor (52) connected to the control unit to transmit pressure signals to the control unit (50).

14. Apparatus as claimed in claim 13, wherein the control unit (50) is configured to record and display a pressure function (66) measured by the pressure sensor (52).

15. Apparatus (7, 8, 9) to supply compressed air to a main blowing nozzle (2, 3, 4) of an airjet loom, comprising: a control unit (50) for the loom; an ON/OFF and/or adjustable valves (23, 24, 26, 28, 58) connected to a compressed air supply (6) and electrical controllers for the valves; an integrated air feed unit (19) comprising an intake (20) connected to the compressed air supply (6), an outlet (21) connected to the main blowing nozzle (2, 3, 4), and ducts (22, 25) associated with the valves (23, 24, 26, 28, 58); the ducts being connected to the intake (20) and the outlet (21); said air feed unit (19) fitted with an electrical connector (46) connected to electrical lines (43, 44, 45, 55, 62) leading to the controllers for the valves (23, 24, 26, 28, 58) and/or an electrically operated pressure sensor (52), the connector receiving one or more electrical connecting elements connected to lines (47, 48, 49) leading to the control unit (50).

16. Apparatus to supply compressed air to a main blowing nozzle of an airjet loom for filling insertion comprising:

a compressed air supply;

an integrated air feed unit comprising an intake that is connected to the compressed air supply, an outlet connected to the blowing nozzle, and at least one duct including a main duct, associated with an adjustable flow control valve, the at least one duct in communication with the valve and connected to the intake and the outlet;

said adjustable valve located within the air feed unit and configured to function both as an ON/OFF check valve to control the supply of compressed air to the outlet during filling insertions and as an adjustable throttling valve configured to control the pressure of compressed air supplied to the outlet during filling insertions, the adjustable valve movable between variable throttling positions whereat the pressure admitted from the main duct to the outlet is controlled by the adjustable valve and a blocking position whereat the adjustable valve completely blocks the main duct; and a single controller for the adjustable valve selectively controllable to move the valve between variable throttling positions and a duct blocking position.

17. Apparatus as claimed in claim 16, including a bypass duct shunting said main duct and adjustable valve, said bypass duct in communication with said main duct and said outlet, and a throttling valve controlling pressure of compressed air supplied to said outlet via said bypass duct when said adjustable valve is in a duct blocking position.

18. Apparatus as claimed in claim 16, including an adjustable air pressure throttling valve in said main duct upstream of said adjustable valve, said throttling valve arranged to control compressed air flow to said adjustable valve.

19. Apparatus as claimed in claim 16, including a compressed air supply manifold having a compressed air outlet opening; said air feed unit directly attached to said manifold with said intake connected to said outlet opening.

20. Apparatus as claimed in claim 16, including a pressure monitoring device attached to the air feed unit at the outlet thereof and arranged to monitor pressure of compressed air supplied to the main blowing nozzle via the outlet.

* * * * *